United States Patent [19]

Stedman

[11] 4,089,431

[45] May 16, 1978

[54] BUCKET WITH REDUCED DUMPING WIDTH

[75] Inventor: Robert N. Stedman, Chillicothe, Ill.

[73] Assignee: Caterpillar Tractor Co., Peoria, Ill.

[21] Appl. No.: 723,408

[22] Filed: Sep. 15, 1976

[51] Int. Cl.[2] ..... E02F 3/82

[52] U.S. Cl. ..... 214/146 R; 37/118 R; 214/145 R

[58] Field of Search ..... 214/140, 145 R, 146 R, 214/307, 703, 740, 767; 37/117.5, 118 R, 118 A, 136, DIG. 5, DIG. 12, DIG. 15; 294/71, 73; 298/7

[56] References Cited

U.S. PATENT DOCUMENTS

| | | | |
|---|---|---|---|
| 1,597,105 | 8/1926 | Pardee | 296/50 |
| 2,556,592 | 6/1951 | Markkula | 214/145 R X |
| 3,039,630 | 6/1962 | Mahr | 214/145 R |
| 3,326,395 | 6/1967 | Williams et al. | 37/118 R X |
| 3,598,266 | 8/1971 | Fisher | 214/767 |
| 3,765,490 | 10/1973 | Logue | 37/118 R X |

FOREIGN PATENT DOCUMENTS

| | | | |
|---|---|---|---|
| 982,816 | 2/1965 | United Kingdom | 37/118 R |
| 176,375 | 12/1965 | U.S.S.R. | 214/140 |

*Primary Examiner*—L. J. Paperner

*Attorney, Agent, or Firm*—Wegner, Stellman, McCord, Wiles & Wood

[57] ABSTRACT

A loader, including a vehicle frame, lift arms mounted on the frame for movement between upper and lower positions, and a bucket having a bottom, a rear and spaced sides, said bottom and sides defining a dumping opening, the bucket being mounted on the lift arms for movement therewith, wherein the improvement comprises a gate pivotally mounted to the bucket for movement between a first position wherein the dumping opening is unobstructed, and a second position wherein the dumping opening is partially obstructed so that the dumping opening may be selectively narrowed when the bucket contents are to be dumped in a restricted area.

8 Claims, 6 Drawing Figures

BUCKET WITH REDUCED DUMPING WIDTH

BACKGROUND OF THE INVENTION

This invention relates to loaders used in earth-moving service and the like and, more specifically, to means for reducing the width of the front portion of a loading bucket to facilitate dumping of the bucket's contents into a separate receptacle such as a dump truck, for example.

It has proven desirable to provide earth-loading buckets with relatively wide entrances, as defined by the front edge and side walls of said buckets, in order to allow the greatest possible amount of material to be loaded into the bucket as the front edge of the bucket loosens and lifts said material as the bucket travels over the terrain to be cleared.

However, relatively wide buckets are difficult to unload when the width of the receptacle is insufficient to accommodate all the falling debris and earth material. This may occur even though the width of the receptacle is greater than the width of the bucket as material falling from a bucket has the tendency to spread outwardly from the sides of the bucket, resulting in loss of material over the front or rear of the receptacle. This is especially inconvenient when the receptacle is a truck without a protective cover for the operator's station at the front of the vehicle.

It has been determined that if the ratio of the width of the receptacle to the width of the bucket is less than about 1.4 to 1, the bucket must be positioned substantially centrally of the receptacle to avoid spillage of material over the sides of the receptacle when emptying the bucket. This is a disadvantage, as centering of a loader with respect to the receptacle may be impractical due to space and time limitations.

When the length of the truck bed (measured from the operator's station to the rear of the bed), or other receptacle, is only slightly greater than the width of the bucket opening, spillage problems may occur even if the bucket is centered with respect to the receptacle. This situation arises in cases where relatively short dump trucks are utilized in material-moving operations.

SUMMARY OF THE INVENTION

It is an object of the invention to provide a new and improved loader for use in earth-moving operations and the like. More specifically, it is an object of the invention to provide a loader, the bucket of which has a relatively wide opening that may be narrowed when the bucket is moved to its dumping position so as to provide a relatively narrow dumping opening which will effectively result in a dumping area of reduced size.

An exemplary embodiment of the invention achieves the foregoing object in a loader having a gate mounted on one of the sides of the bucket of said loader for movement between a first position wherein the gate extends forwardly from a side of the bucket and does not obstruct the dumping opening of the bucket, and a second position wherein the gate extends inwardly from a side in order to partially obstruct the dumping opening.

One version of the above embodiment includes a hydraulic cylinder mounted on the top of the bucket and connected to a pivot arm of the gate to effect movement of the gate between its first and second positions.

Another embodiment of the invention comprises a loader with a gate mounted on the rear of the loader's bucket in close proximity to a side of the bucket for rotation between a first position wherein the gate extends forwardly from the rear of the bucket and is disposed against the bottom of the bucket, and a second position wherein the gate extends upwardly and forwardly of its mounting point on the rear of the bucket, thereby partially obstructing the dumping opening thereof.

In one preferred embodiment of the invention, the above gate comprises a rigid member which includes a rear lever portion which extends rearwardly from the bucket for abutment against a lifting arm of the loader, thereby serving to move the gate between its first and second positions as the lift arm is moved between its lower and upper positions.

One highly preferred embodiment of the invention comprises the above loaders with a second gate mounted at the opposite side of the bucket.

Other objects and advantages will become apparent from the following specifications taken in connection with the accompanying drawings.

DESCRIPTION OF THE PREFERRED EMBODIMENT

Figure 1:
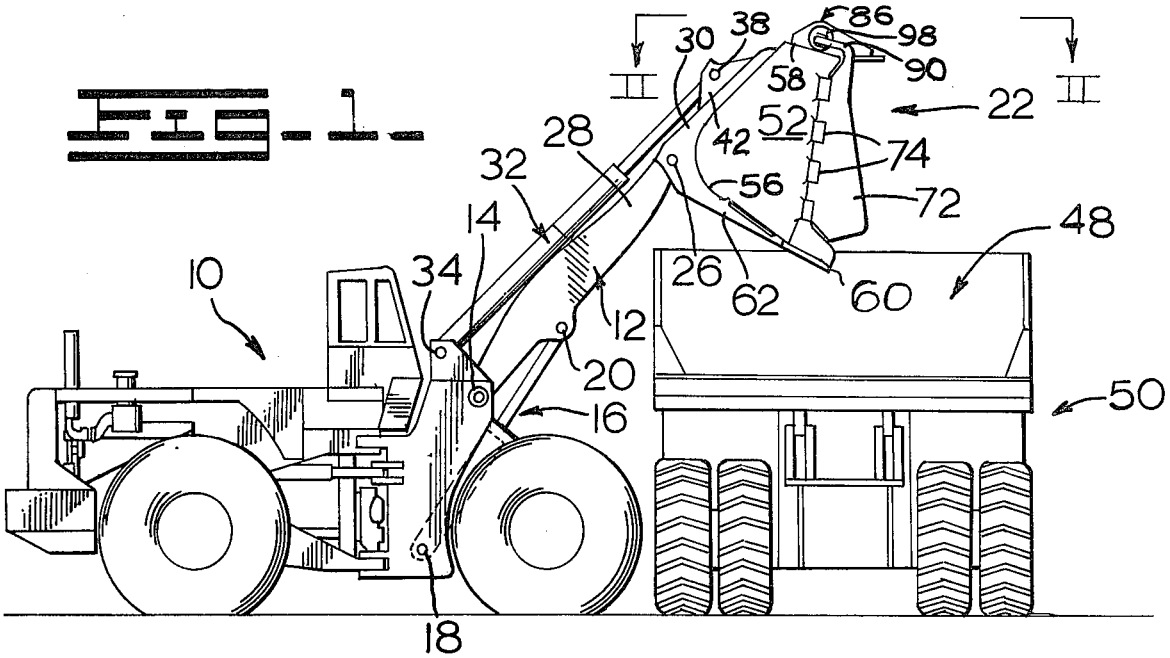
FIG. 1 is a side elevational view of a loader used in earth-moving or loading operations and embodying the invention.

Referring to FIG. 1, an exemplary embodiment of a loader made according to the invention includes a wheeled vehicle frame, generally designated 10, provided with lifting arms 12 which are pivotally mounted to the frame 10 by pivots 14. Hydraulic cylinders 16 are mounted to the frame 10 by pivots 18 and to the arms 12 by pivots 20. Operation of the cylinders 16 raises or lowers the arms 12 in a known manner.

Figure 2:
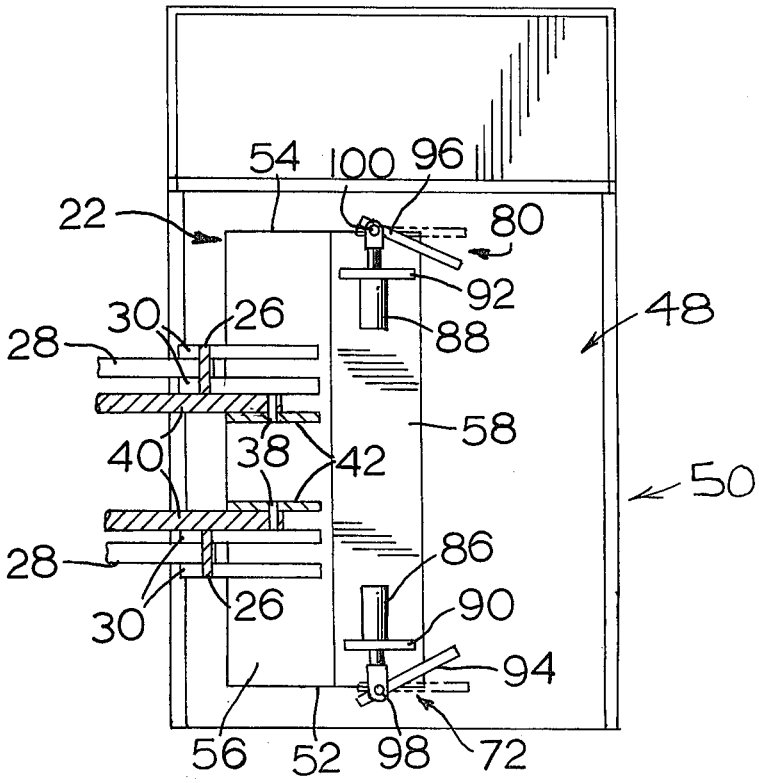
FIG. 2 is a view of the loader taken along line 2—2 of FIG. 1.
Figure 3:
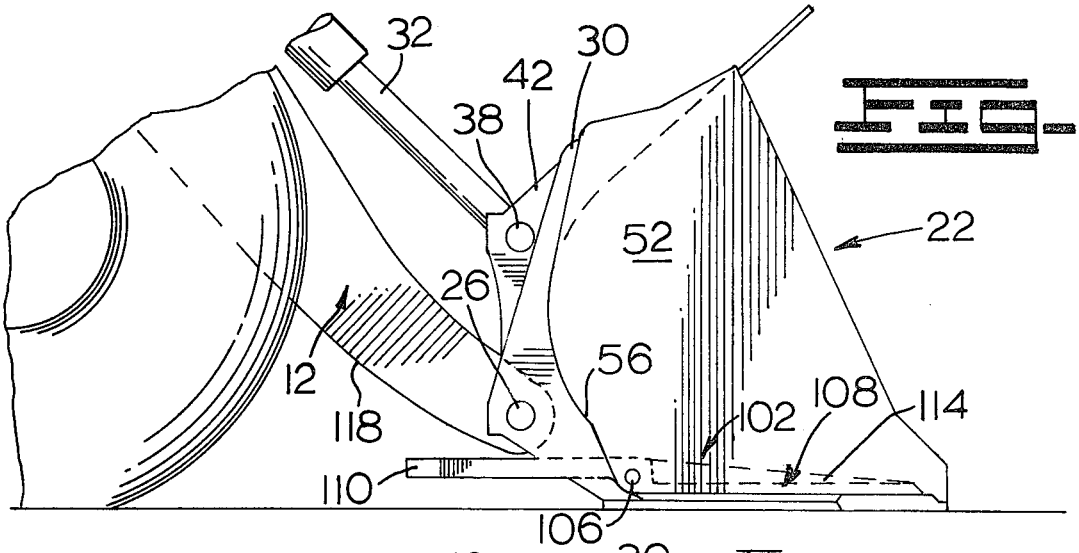
FIG. 3 is an enlarged, fragmentary side elevational view of a modified embodiment of the invention.

As best seen in FIG. 2, a bucket, generally designated 22, is pivotally mounted to the arms 12 by pins 26 which extend through the ends 28 of the arms 12 and through two pairs of arcuate ribs 30 which form rear and bottom supports for the bucket 22.

Referring again to FIG. 1, hydraulic cylinders 32 are pivotally mounted to the frame 10 by pivots 34 and to the bucket 22 by pins 38 located above the pins 26. The pins 38 extend through the ends 40 of the cylinders 32 and through brackets 42 (FIG. 2) which form an integral part of the bucket 22. Operation of the cylinders 32 tilts the bucket 22 on the arms 12, as is well known, thereby allowing material contained in the bucket 22 to fall therefrom into a suitable receptable, such as the bed 48 of dump truck 50.

The bucket 22 has spaced side walls 52 and 54, an arcuate rear and bottom wall 56, and a spill plate 58. A front edge 60, as shown in FIG. 1, is disposed forwardly of the wall 56 and the forward extremities 62 of the ribs 30.

Referring to FIG. 2, the side wall 52 of the bucket 22 is provided with a forwardly extending gate 72 which is pivotally mounted to the side wall 52 by a hinge 74 for movement between a first position shown in dotted lines wherein the gate extends forwardly from side wall 52, and a second position wherein the gate extends forwardly and inwardly from side wall 52, as shown in solid lines in FIG. 2. A similar gate 80 is pivotally mounted to the side wall 54 for movement between a similar first position and second position. Hydraulic cylinders 86 and 88 are mounted on the spill plate 58 by brackets 90 and 92 and are pivotally connected to the gates 72 and 80 by arms 94 and 96 thereon, respectively, as by pins 98 and 100.

Extension of the cylinders 86 and 88 pivots the gates 72 and 80, respectively, from their respective first positions to their second positions, thereby partially obstructing the entrance 66 to the bucket 22 so as to effectively narrow the dumping opening.

Loading of the bucket 22 may be accomplished with the gates 72 and 80 disposed in their first positions, thereby providing the dumping opening 66 with its greatest possible width. When the bucket 22 is in its dumping position (shown in FIG. 1) over the receptacle 48, the operator of vehicle 10 may actuate either or both of the cylinders 86 and 88, thereby moving gates 72 and 80 to their second positions so as to narrow the bucket opening.

Either of the gates 72 or 80 may be operated independently of the other, or simultaneously, at the option of the operator. It may be desirable to operate only one of the gates in situations where there is sufficient clearance between one side of the bucket and the corresponding boundary of the receptacle to avoid spillage of material as it is dumped.

The resultant narrowing of the bucket opening limits the outward spread of material as it is dumped from the bucket 22. This will allow the vehicle's operator to position the bucket 22 in a dumping position over receptacle 48 without positioning the center of the bucket substantially centrally of the receptacle.

In cases where the reaceptacle is only slightly wider than the bucket, spillage problems may occur even if the bucket is centered over the receptacle. This is often the case where relatively short dump trucks are used to receive and transport material. Narrowing of the bucket opening as described above acts to restrict the area into which the dumped material will spread, thereby allowing relatively wide buckets to be used with short receptacles.

FIGS. 3–6 illustrate an alternative embodiment of the invention wherein gates 102 and 104 are pivotally mounted to the side walls 52 ad 54 of the bucket 22 as by pins 106 which extend substantially perpendicularly to the walls 52 and 54.

Figure 6:
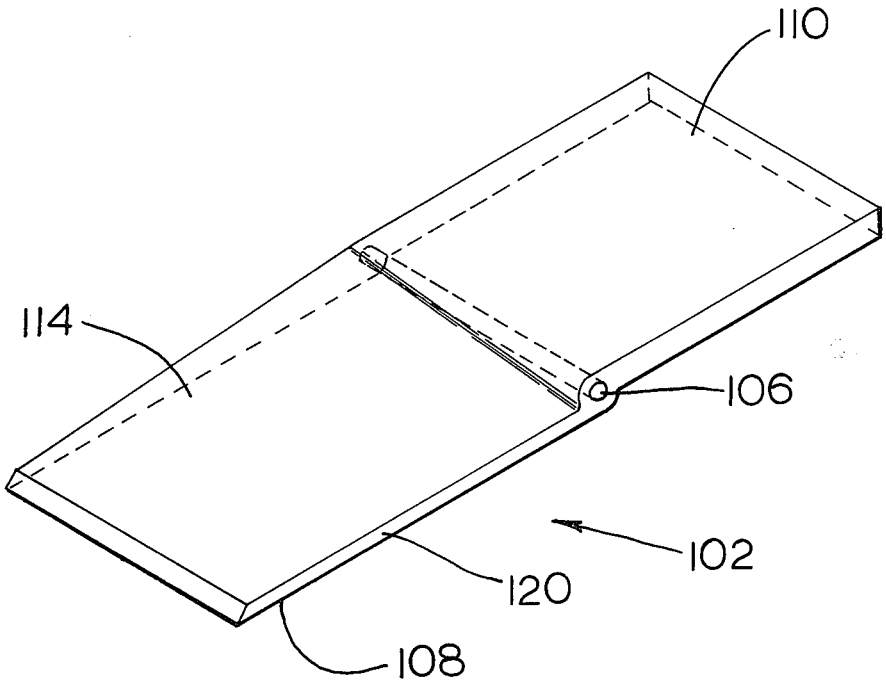
FIG. 6 is a perspective view of one of the gates shown in FIGS. 3–5.

The gates 102 and 104 each include a wedge-shaped plate 108 which extends forwardly of the respective pivot pins 106 and levers 110 which extend rearwardly of the associated pins through the rear wall 56 and which underlie the arms 12. The plates 108 each include a flat bottom 112 and a tapered upper surface 114. As shown in FIG. 6, the surfaces 114 taper both forwardly from the associated pin 106 and inwardly from the corresponding walls 52 and 54. The plates 108 are substantially heavier than the associated levers 110 so as to normally reside in the position illustrated in FIG. 3 due to the influence of gravity.

The gates 102 and 104 are pivotal on pins 106 between a first position wherein the bottom portions 112 are disposed against the bottom of the bucket 22, and a second position wherein the plates 108 extend forwardly and upwardly of the pivot axes defined by pins 106.

Figure 4:
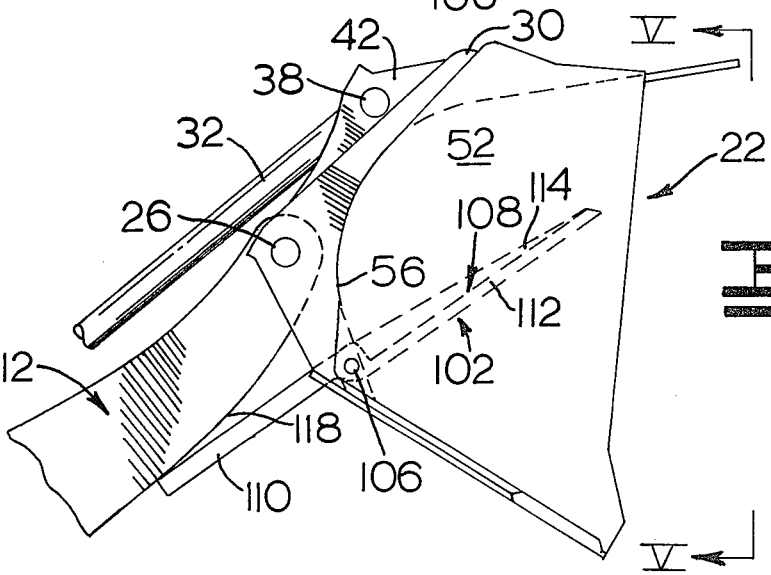
FIG. 4 is an enlarged, fragmentary side elevational view of the embodiment of FIG. 3 in dumping position.
Figure 5:
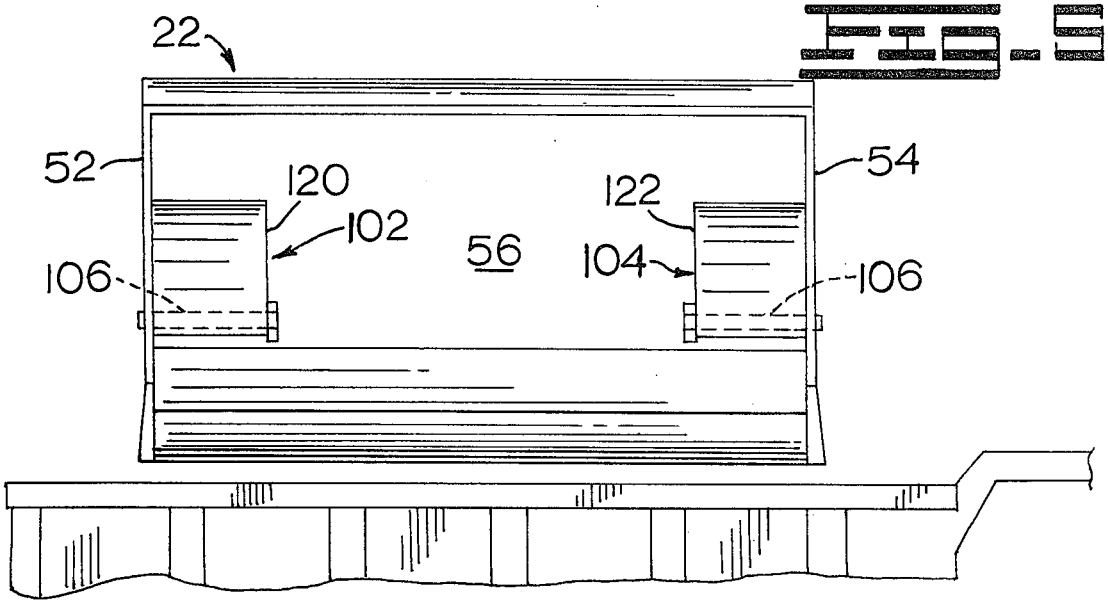
FIG. 5 is a view of the bucket of FIG. 4 taken substantially along line 5—5 of FIG. 4.

Movement of the gates 102 and 104 from the first position to the second position is effected by the abutment of levers 110 against the undersurface 118 of the arms 12 when the arms are moving toward an elevated position, as shown in FIG. 4.

Tilting of the bucket to a dumping position will cause the gates to move fully to their second position, as shown in FIG. 4.

The gates 102 and 104 serve to narrow the effective dumping width of the bucket 22 when the gates are in their second position. Material positioned between the gates and the rear wall 56 will slide inwardly from the side walls 52 and 54 due to the inward taper of the surface 114 of each gate. Thus, the downward flow of material will be substantially limited to the area between the inner edges 120 and 122 of gates 102 and 104 during dumping.

After dumping, the gates 102 and 104 will return to their first positions simply by means of returning the bucket 22 to its loading position (shown in FIG. 3), as the plates 108 are heavier than levers 110 and will pivot from their second positions to their first positions due to the influence of gravity.

From the foregoing, it may be appreciated that a loader made according to the invention will provide a relatively wide loading width while allowing selective narrowing of the dumping width. As a consequence, the need to center the bucket with respect to the receptacle when dumping will be obviated, resulting in economy of time and reduction of spillage.

What is claimed is:

1. In a loader including a vehicle frame, lift arms mounted on the frame for movement between upper and lower positions, and a bucket having a bottom, rear and fixed spaced sides, said bottom and sides defining an elongated dumping opening and mounted on said lift arms for movement therewith, the improvement comprising:

two gates;

pivot means for mounting each said gate on a respective one of said sides for movement between a first position wherein each said gate extends forwardly of its respective side and does not obstruct said dumping opening, and a second position wherein each said gate extends inwardly from its respective side and partially obstructs said dumping opening, said gates, when both are in their second positions, narrowing, but not closing said dumping opening; and motor means connected to said gates for moving said gates between said first and second positions;

whereby when said gates are in their first position, the full width of said opening is availble for loading and for dumping and when said gates are in said second position, said opening is narrowed for dumping into a confined area.

2. In a loader including a vehicle frame, lift arms mounted on the frame for movement between upper and lower positions, and a bucket having a bottom, rear and fixed spaced sides, said bottom and sides defining an elongated dumping opening and mounted on said lift arms for movement therewith, the improvement comprising:

two gates, each said gate having an arm;

pivot means for mounting each said gate on a respective one of said sides for movement between a first position wherein each said gate extends forwardly of its respective side and does not obstruct said dumping opening, and a second position wherein each said gate extends inwardly from its respective side and partially obstructs said dumping opening, said gates, when both are in their second positions, narrowing, but not closing, said dumping opening; and motor means connected to said gate arms for pivoting said gates between said first and second positions;

whereby when said gates are in their first position, the full width of said opening is available for loading and for dumping and when said gates are in said second position, said opening is narrowed for dumping into a confined area.

3. In a loader including a vehicle frame, lift arms mounted on the frame for movement between upper and lower positions, and a bucket having a bottom, rear and fixed spaced sides, said bottom and sides defining an elongated dumping opening and mounted on said lift arms for movement therewith, the improvement comprising:

two gates, each said gate having an arm;

pivot means along said bucket sides for mounting each said gate on a respective one of said sides for movement between a first position wherein each said gate extends forwardly of its respective side and does not obstruct said dumping opening, and a second position wherein each said gate extends inwardly from its respective side and partially obstructs said dumping opening, said gates, when both are in their second positions, narrowing, but not closing, said dumping opening; and reciprocal means mounted on said bucket above said opening and connected to said gate arms at locations spaced from said pivot means for moving said gates between said first and second positions;

whereby when said gates are in their first position, the full width of said opening is available for loading and for dumping and when said gates are in said second position, said opening is narrowed for dumping into a confined area.

4. In a loader including a vehicle frame, lift arms mounted on the frame for movement between upper and lower positions, and a bucket having a bottom, a rear and spaced sides defining a dumping opening and mounted for movement with said lift arms, the improvement comprising:

a gate comprising a rigid member, and pivot means for mounting said gate on the rear in close proximity to a side of said bucket for rotation between a first position wherein the forward portion of said gate extends forwardly from the rear of the bucket and is disposed against the bottom of said bucket and does not obstruct said dumping opening, and a second position wherein said forward portion extends upwardly from the bottom and forwardly of the rear of said bucket and partially obstructs said dumping opening.

5. The loader of claim 4 wherein said forward portion of the gate comprises a plate including a flat base and a wedge-shaped upper portion, the surface of said upper portion tapering forwardly from the rear of the bucket and inwardly from the side of the bucket.

6. The loader of claim 4 wherein lever means are provided for movement of the gate between said first and second positions.

7. The loader of claim 5 wherein said lever means comprises a portion of the gate, said portion extending rearwardly of the rear of said bucket for abutment against said lift arms when the gate is in its second position.

8. The loader of claim 6 wherein the portion of the gate extending forwardly of the rear of the bucket is heavier than the portion of the gate extending rearwardly of the rear of the bucket.

* * * * *